US010988362B2

(12) United States Patent
Araki

(10) Patent No.: US 10,988,362 B2
(45) Date of Patent: Apr. 27, 2021

(54) WORK VEHICLE INCLUDING SUSPENDED PLATFORM

(71) Applicant: Nihon Bisoh Co., Ltd., Tokyo (JP)

(72) Inventor: Chihiro Araki, Tokyo (JP)

(73) Assignee: Nihon Bisoh Co., Ltd., Tokyo (JP)

( * ) Notice: Subject to any disclaimer, the term of this patent is extended or adjusted under 35 U.S.C. 154(b) by 134 days.

(21) Appl. No.: 16/341,535

(22) PCT Filed: Sep. 22, 2017

(86) PCT No.: PCT/JP2017/034298
§ 371 (c)(1),
(2) Date: Apr. 12, 2019

(87) PCT Pub. No.: WO2018/074140
PCT Pub. Date: Apr. 26, 2018

(65) Prior Publication Data

US 2019/0256335 A1 Aug. 22, 2019

(30) Foreign Application Priority Data

Oct. 17, 2016 (JP) ..... JP2016-203811

(51) Int. Cl.

| | |
|---|---|
| ***B66F 11/04*** | (2006.01) |
| ***B66F 17/00*** | (2006.01) |
| ***B66F 13/00*** | (2006.01) |
| ***E01D 22/00*** | (2006.01) |
| ***B66F 9/06*** | (2006.01) |

(52) U.S. Cl.
CPC ..... *B66F 17/006* (2013.01); *B66F 9/06* (2013.01); *B66F 11/046* (2013.01); *B66F 13/00* (2013.01); *E01D 22/00* (2013.01)

(58) Field of Classification Search
CPC ..... B66F 17/006; B66F 11/046
See application file for complete search history.

(56) References Cited

U.S. PATENT DOCUMENTS 4,456,093 A * 6/1984 Finley ..... B66F 17/006 182/18
5,713,430 A * 2/1998 Cohen ..... E04G 3/34 182/142

(Continued)

FOREIGN PATENT DOCUMENTS

CA 2258471 A1 * 10/1999 ..... B66C 13/12
CN 85103124 A 10/1986

(Continued)

OTHER PUBLICATIONS

Seiichi, Imano, "Notification of Reasons for Rejection for Japanese Patent Application No. 2016-203811," Japanese Patent Office, dated Jun. 20, 2017.

(Continued)

*Primary Examiner* — Alvin C Chin-Shue
(74) *Attorney, Agent, or Firm* — Florek & Endres PLLC

(57) ABSTRACT

A work vehicle (1) including a suspended platform includes a work cage (10) to carry an operator, an arm mechanism (60) having a distal end, the distal end movable to an intended position by at least one of a rotating mechanism (30), an extension mechanism (40), or a derricking mechanism (50) installed on a vehicle body (20). The suspended platform (100) includes a support post (70) located at the distal end of the arm mechanism (60), a suspension frame (80), from which the work cage (10) is suspended, mounted on an upper end of the support post (70) to allow the operator to perform an operation above the upper end of the support post (70), and a lift mechanism (90) that raises or lowers the work cage (10) suspended from the suspension frame (80) with a plurality of lanyards (91) to a work position.

8 Claims, 9 Drawing Sheets

(56) References Cited

U.S. PATENT DOCUMENTS

| | | | | |
|---|---|---|---|---|
| 5,845,739 | A * | 12/1998 | Ohtsuki | E04G 3/34 182/37 |
| 2004/0026171 | A1* | 2/2004 | Chang | A62B 1/02 182/145 |
| 2008/0283334 | A1* | 11/2008 | Fickey | A01M 31/006 182/20 |
| 2011/0088970 | A1* | 4/2011 | Beji | B66F 17/006 182/18 |
| 2016/0214842 | A1 | 7/2016 | Herauf | |
| 2016/0287918 | A1* | 10/2016 | Huehn | A62C 27/00 |

FOREIGN PATENT DOCUMENTS

| | | | | |
|---|---|---|---|---|
| CN | 103243647 | A | | 8/2013 |
| GB | 2384481 | A | | 7/2003 |
| JP | 11229799 | A | * | 8/1999 |
| JP | H11-229799 | A | | 8/1999 |
| JP | 2000302389 | A | | 10/2000 |
| JP | 2002-053297 | A | | 2/2002 |
| JP | 2003128392 | A | | 5/2003 |
| JP | 2009228358 | A | | 10/2009 |
| JP | 2016011211 | A | | 1/2016 |
| JP | 6189512 | B1 | | 8/2017 |

OTHER PUBLICATIONS

"Written Opinion of the International Searching Authority for International Application No. PCT/JP2017/034298," Japanese Patent Office, dated Nov. 27, 2017.

Mi, Xiang, "First Notification of Office Action for CN patent application No. 201780063717.2," The Patent Office of the People's Republic of China, dated Jul. 21, 2020.

* cited by examiner

WORK VEHICLE INCLUDING SUSPENDED PLATFORM

TECHNICAL FIELD

The present disclosure relates to a work vehicle including a suspended platform. More particularly, the present disclosure relates to a work vehicle with a suspended platform that travels to a structure such as a road bridge for inspection or maintenance of the entire wall surfaces of bridge piers.

BACKGROUND ART

In the construction or maintenance of structures such as buildings, vessels, power plants, tanks, smokestacks, and bridges, suspended platforms including work cages have been used for safe and efficient high-rise operations on the wall surfaces. A suspended platform is installed on a rooftop, and has a work cage carrying an operator, which is suspended from the rooftop with lanyards such as wires.

The work cage of the suspended platform carries an operator who performs an operation on the wall surfaces while being lowered from the rooftop by changing the positions of the lanyards wound around the sheaves of endless winders (refer to, for example, Patent Literature 1).

For inspection or maintenance of road bridges or other structures, boom lift vehicles (bridge inspection vehicles) are used. A boom lift vehicle includes an arm mechanism and a work cage installed at the distal end of the arm mechanism, and moves the distal end of the arm mechanism to an intended position in combination with a rotating mechanism, an extension mechanism, and a derricking mechanism installed on the vehicle.

For example, an operator in the work cage of the boom lift vehicle moves the distal end of the arm mechanism to a work position from above the road to allow the operator in the work cage installed at the distal end to perform an operation (refer to, for example, Patent Literature 2).

CITATION LIST

Patent Literature

Patent Literature 1: Unexamined Japanese Patent Application Kokai Publication No. 2009-228358

Patent Literature 2: Unexamined Japanese Patent Application Kokai Publication No. 2003-128392

SUMMARY OF INVENTION

Technical Problem

A boom lift vehicle may be used for inspection or maintenance of structures, such as bridges, with heights of several tens of meters, such as bridge piers. However, the boom lift vehicle cannot access specific areas with the distal end of the arm mechanism that is extended or contracted from above the road, and thus has a limited operating range. In contrast, a suspended platform can use longer lanyards to suspend a work cage for operations in the descending range without limitations. However, the suspended platform including the work cage suspended from a road cannot access areas above its suspension point, areas at the bottom surface of the road slab, or areas below the bottom surface, and thus cannot perform operations in such areas.

In view of the above circumstances, an objective of the present disclosure is to provide a work vehicle including a suspended platform that is movable to an intended position to perform operations in a wide operating range without limitations.

Solution to Problem

A work vehicle including a suspended platform according to a first aspect of the present disclosure includes a work cage to carry an operator, an arm mechanism having a distal end, the distal end being movable to an intended position by at least one of a rotating mechanism, an extension mechanism, or a derricking mechanism that are installed on a vehicle body, and the suspended platform including a support post located at the distal end of the arm mechanism and extending vertically, a suspension frame, from which the work cage is suspended, mounted on an upper end of the support post, being located outside the work cage, allowing the operator to perform an operation on a portion above the upper end of the support post, and a lift mechanism configured to raise or lower to a work position, the work cage being suspended from the suspension frame with a plurality of lanyards. The arm mechanism includes an operation panel that is operable from the work cage at an uppermost stop position and inoperable from the work cage at a raised or lowered position.

A work vehicle including a suspended platform according to a second aspect of the present disclosure includes a work cage to carry an operator, an arm mechanism having a distal end, the distal end movable to an intended position by at least one of a rotating mechanism, an extension mechanism, or a derricking mechanism that are installed on a vehicle body, the suspended platform including a support post located at the distal end of the arm mechanism and extending vertically, a suspension frame, from which the work cage is suspended, mounted on an upper end of the support post, being located outside the work cage, allowing the operator to perform an operation on a portion above the upper end of the support post, and a lift mechanism configured to raise or lower the work cage to a word position, the work cage being suspended from the suspension frame with a plurality of lanyards, a fastening mechanism located between the work cage and the suspension frame to fasten the work cage at an uppermost stop position, and a load detector installed in the suspension frame to detect a fastened state of the work cage at the uppermost stop position based on a load on at least one of the lanyards.

A work vehicle including a suspended platform according to a third aspect of the present disclosure includes a work cage to carry an operator, an arm mechanism having a distal end, the distal end being movable to an intended position by at least one of a rotating mechanism, an extension mechanism, or a derricking mechanism that are installed on a vehicle body, and the suspended platform including a support post located at the distal end of the arm mechanism and extending vertically, a suspension frame, from which the work cage is suspended, mounted on an upper end of the support post, being located outside the work cage, allowing the operator to perform an operation on a portion above the upper end of the support post, and a lift mechanism configured to raise or lower the work cage to a work position, the work cage being suspended from the suspension frame with a plurality of lanyards. The lift mechanism in the suspended platform is driven by a battery mounted on the work cage. The work cage has the battery rechargeable at an uppermost stop position with power from an external power supply.

The arm mechanism may include an operation panel operable from the work cage at the uppermost stop position and inoperable from the work cage at a raised or lowered position.

The work vehicle may further include a fastening mechanism located between the work cage and the suspension frame to fasten the work cage at the uppermost stop position, and a load detector installed in the suspension frame to detect a fastened state of the work cage at the uppermost stop position based on a load on at least one of the lanyards.

The support post may include a rotating post that rotates about a vertical axis.

Advantageous Effects of Invention

The work vehicle including the suspended platform according to the above aspects of the present disclosure is movable to an intended position to perform operations in a wide operating range without limitations.

DESCRIPTION OF EMBODIMENTS

A work vehicle including a suspended platform according to an embodiment of the present disclosure will now be described in detail with reference to the accompanying drawings.

Figure 1:
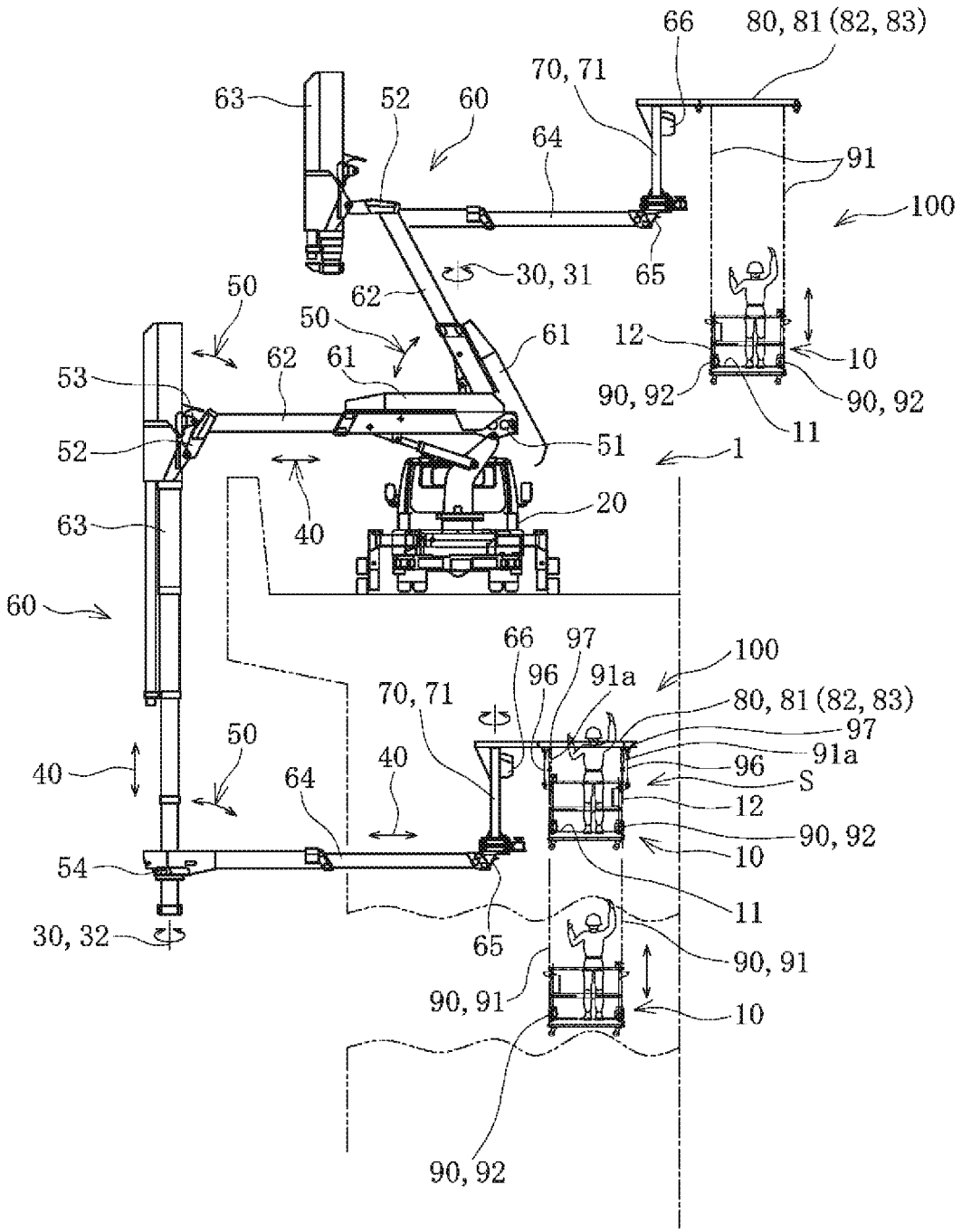
FIG. 1 is a schematic diagram of a work vehicle including a suspended platform according to one embodiment of the present disclosure.

As shown in FIG. 1, a work vehicle 1 including a suspended platform according to one embodiment of the present disclosure includes a work cage 10 to carry an operator, and an arm mechanism 60, which has a distal end movable to an intended position by at least one of a rotating mechanism 30, an extension mechanism 40, or a derricking mechanism 50 installed on a vehicle body 20. The work vehicle 1 includes a suspended platform 100, which includes a support post 70, a suspension frame 80, and lift mechanisms 90. The support post 70 is located at the distal end of the arm mechanism 60 and extends vertically. The suspension frame 80, from which the work cage 10 is suspended, is located at the upper end of the support post 70 to allow the operator to perform an operation above the upper end of the support post 70. The lift mechanisms 90 raise or lower the work cage 10, suspended from the suspension frame 80 with multiple lanyards 91, to a work position.

More specifically, the work vehicle 1 including the suspended platform 100 according to the present embodiment (hereinafter simply, the work vehicle) includes the suspension frame 80, which allows the suspended platform 100 to be suspended from the suspension frame 80 with the support post 70 at the distal end of the arm mechanism 60 installed on the vehicle body 20, and the lift mechanism 90, which raises or lowers the work cage 10 suspended from the suspension frame 80 with the lanyards 91. The work vehicle 1 can freely travel on roads or other surfaces. The work vehicle 1 can move the distal end of the arm mechanism 60 on the vehicle body 20 to an intended position, and can raise or lower the work cage 10 suspended from the suspension frame 80 at the distal end of the arm mechanism 60. An operator can thus perform an operation in the work cage 10 at an intended position within a wide operating range in which the work cage 10 is raised or lowered, and also an operation above the suspension frame 80 without limitations, and can perform an operation in a wide range, and can perform an operation in a wide operation range.

The work vehicle 1 according to the present embodiment is used as, for example, a bridge inspection vehicle, which is one of boom lift vehicles. Similarly to a known bridge inspection vehicle, the work vehicle 1 includes, on the vehicle body 20, the arm mechanism 60, which can move the distal end of the arm to an intended position. The arm mechanism 60 may include one or more rotating mechanisms 30, one or more extension mechanisms 40, and one or more derricking mechanisms 50.

As shown in FIG. 1, the arm mechanism 60 includes, for example, four booms, or a first boom 61, a second boom 62, a third boom 63, and a fourth boom 64, from the base end to the distal end.

The first boom 61 includes multiple extendable booms, which are extendable and retractable with the extension mechanism 40. The first boom 61 is attached to a rotating platform 31 via a derricking shaft 51, which extends parallel to the vehicle body 20 of the derricking mechanism 50. The rotating platform 31 serves as the rotating mechanism 30 that rotates about the vertical axis on the vehicle body 20. The first boom 61 can thus rotate and derrick.

The second boom 62 includes multiple extendable booms, which are extendable and retractable with the extension mechanism 40. The second boom 62 is attached to a leveling arm 52, which serves as the derricking mechanism 50 at the distal end of the first boom 61, via a rotating platform 32 that allows the third boom 63 to rotate.

The third boom 63 includes multiple extendable booms, which are extendable and retractable with the extension mechanism 40. The third boom 63 is attached via a derricking shaft 53, which serves as the derricking mechanism 50 at the distal end of the second boom 62.

The fourth boom 64 is coupled to the distal end of the third boom 63 via a derricking shaft 54 of the derricking mechanism 50, which allows derricking of the fourth boom 64. A work cage mount 65, which can level the work cage 10, is located at the distal end of the fourth boom 64.

The rotating mechanism 30, the extension mechanism 40, and the derricking mechanism 50 attached to the first to fourth booms 61 to 64 together form the arm mechanism 60, which moves the distal end of the fourth boom 64 to an intended position.

The rotating mechanism 30, the extension mechanism 40, and the derricking mechanism 50 of the arm mechanism 60 include a hydraulic driving device, such as a hydraulic cylinder or a hydraulic motor, or an electric driving device. An operator operates the work vehicle 1 from an uppermost stop position S of the work cage 10 (described later) through an arm operation panel 66 for the arm mechanism 60.

Besides the hydraulic driving mechanism, the work vehicle 1 has a power source of AC 100 to 220 V fed from a generator installed on the vehicle body 20 to feed power to the arm operation panel 66.

The structure of the arm mechanism 60 is a mere example applied to a bridge inspection vehicle. The number of booms or the arrangement of the mechanisms 30, 40, and 50 for coupling the booms is not limited to the number or the arrangement described in this embodiment, and may be determined appropriately to enable movement of the distal end of the arm mechanism 60 to an intended position.

The suspended platform 100 is installed at the distal end of the arm mechanism 60, or specifically on the work cage mount 65 at the distal end of the fourth boom 64 in the present embodiment.

A vertically extending support post 70 is mounted on the work cage mount 65. In the present embodiment, the support post 70 serves as a rotating post 71, which rotates about a vertical axis on the work cage mount 65.

The work cage mount 65, on which the support post 70 is mounted, may be rotated about the vertical axis by the arm mechanism 60. In this case, the support post 70 may be fixed, but can function similarly to the rotating post 71.

The work cage mount 65 included in the arm mechanism 60 may be rotated with an operation on a work cage operation panel 94, which will be described later.

For example, the rotating mechanism of the rotating post 71 is driven by rotating a worm installed on the work cage mount 65 and engaged with a worm wheel attached to the rotating post 71. The worm is rotated with a manual handle, or driven by a hydraulic motor or an electric motor.

Figure 4:
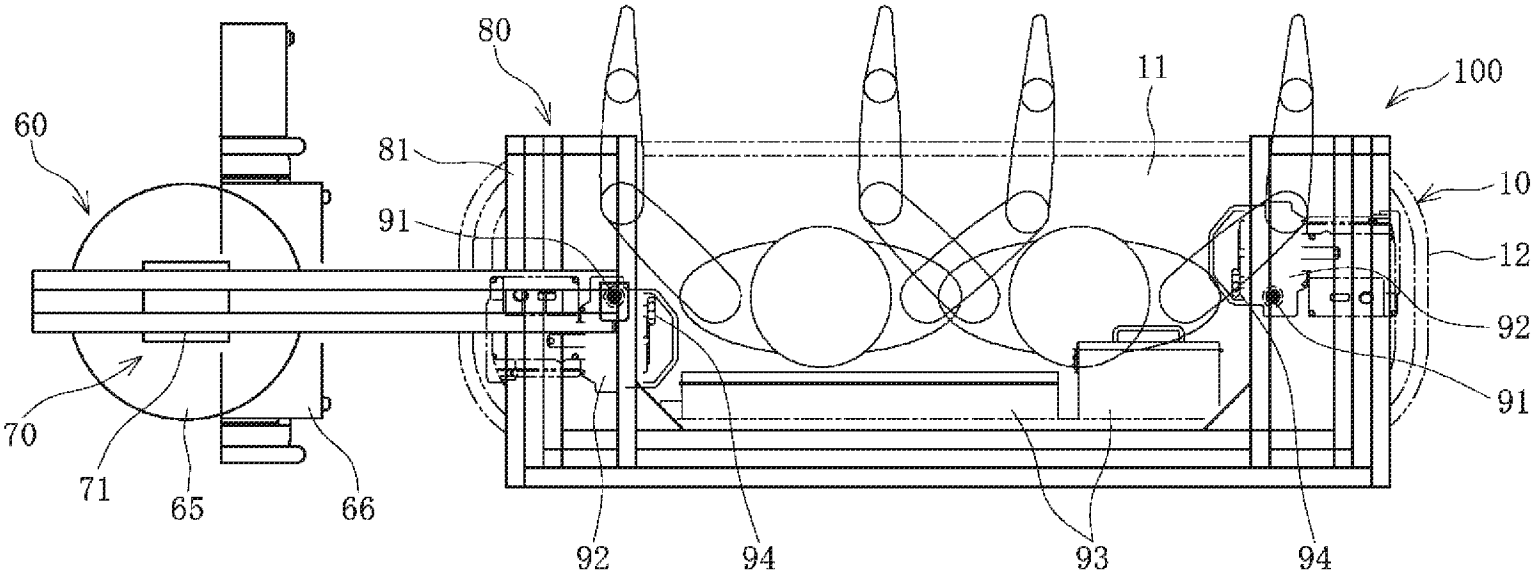
FIG. 4 is a schematic plan view of the suspended platform according to one embodiment of the present disclosure.
Figure 6:
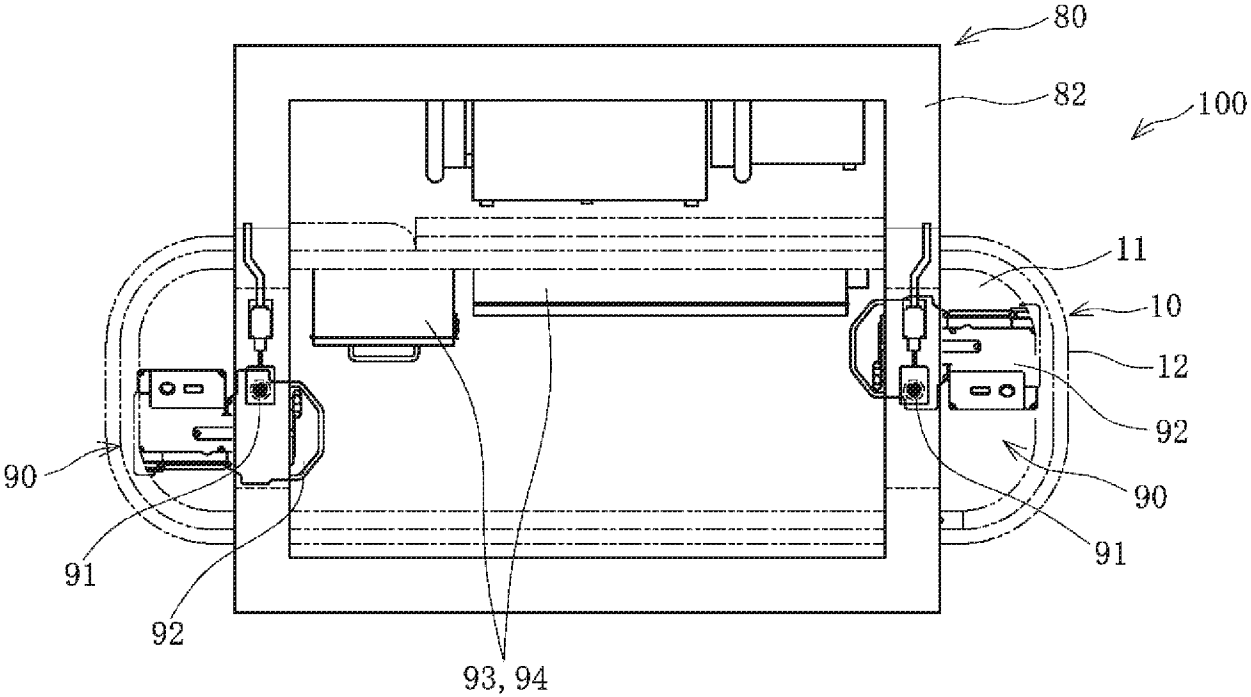
FIG. 6 is a schematic front view of a suspension frame according to another embodiment of the present disclosure.
Figure 7:
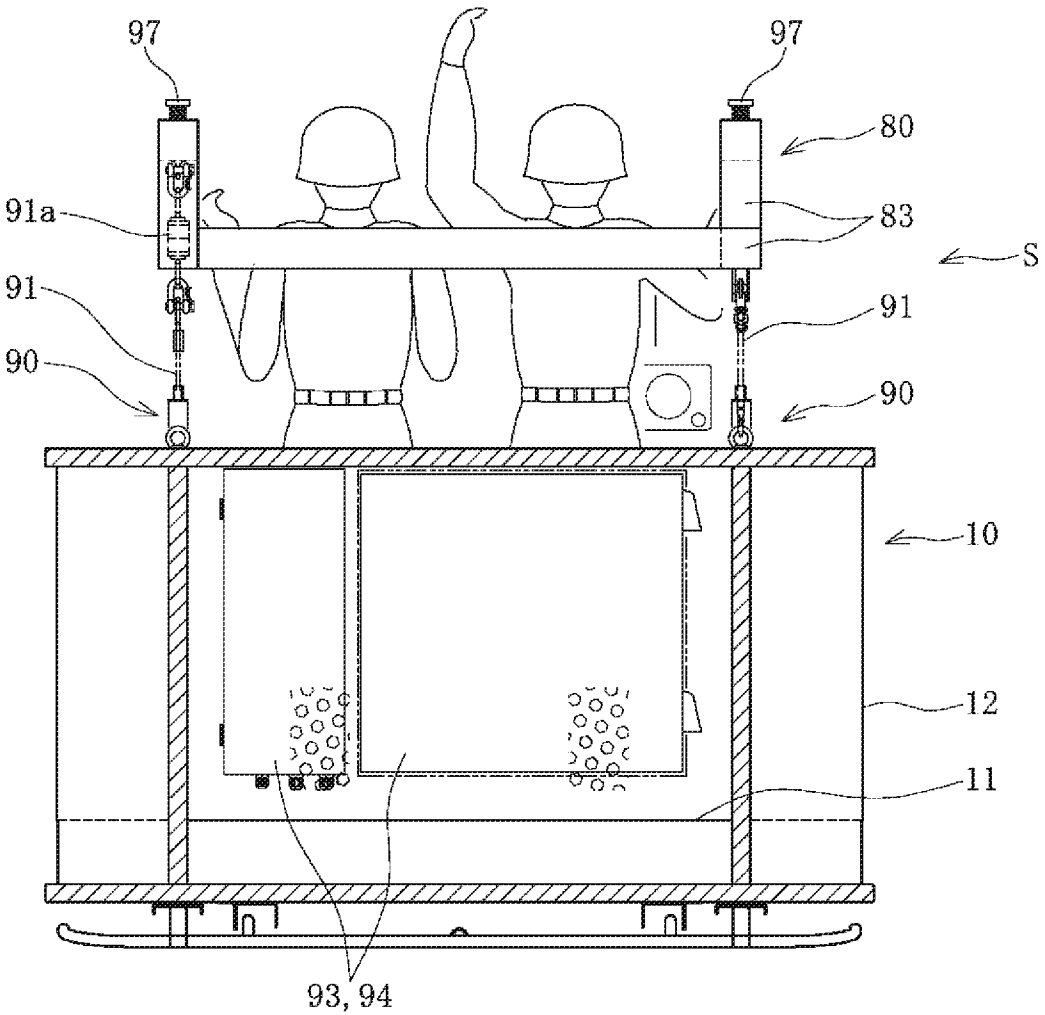
FIG. 7 is a schematic plan view of a suspension frame according to still another embodiment of the present disclosure.
Figure 8:
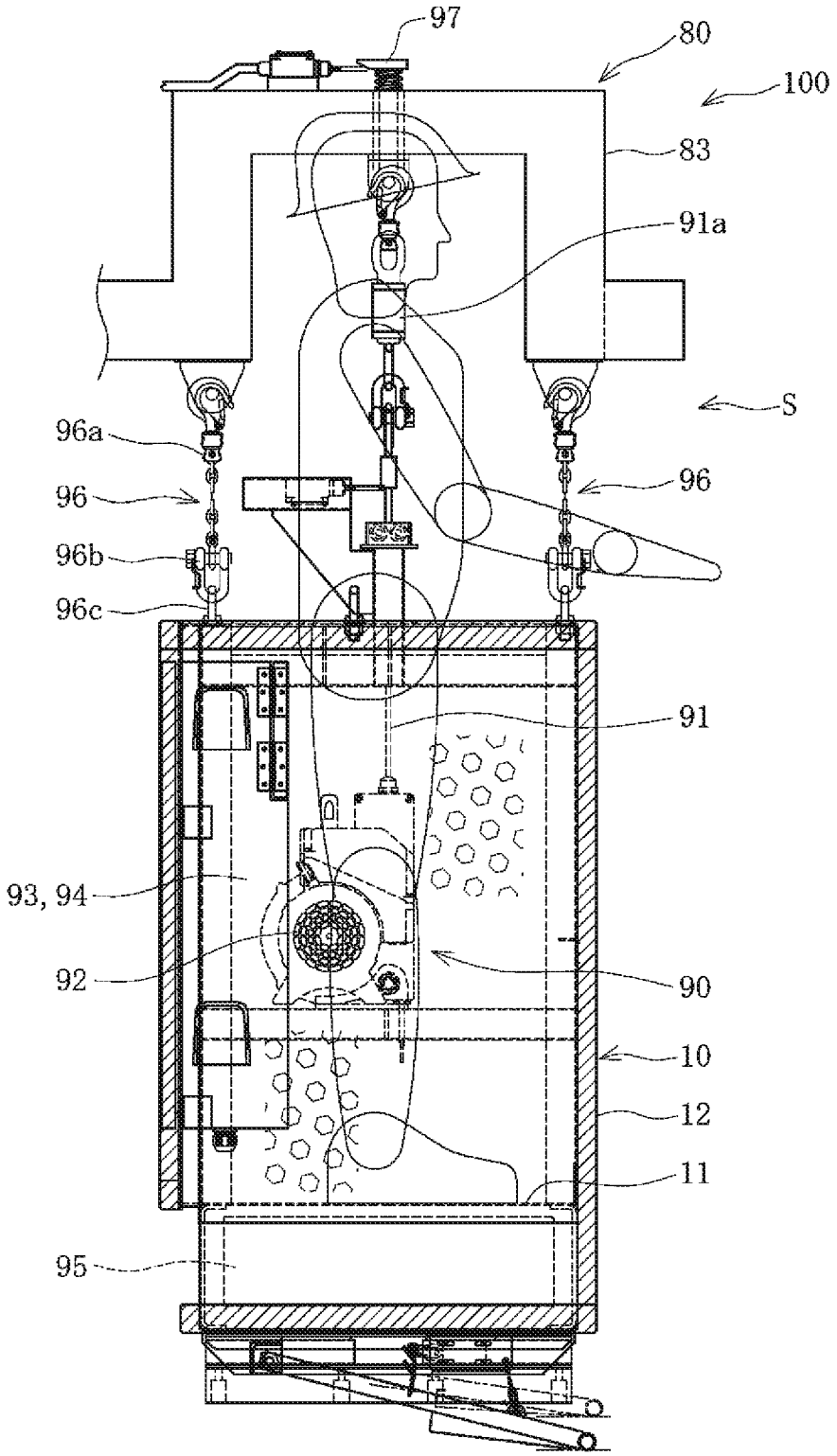
FIG. 8 is a schematic side view of a suspended platform according to one embodiment of the present disclosure.

The suspension frame 80 is a wide frame 81 (refer to FIG. 4) recessed as viewed from above, or a substantially rectangular (refer to FIG. 6) frame 82, mounted on the upper end of the rotating post 71. The frame 81 or 82 has one short side with its center portion protruding toward the rotating post 71 for attachment to the rotating post 71. As shown in FIG. 8, instead of being a flat frame, the suspension frame 80 may be a frame 83 combined with sides each having a downward recess in vertical cross section (refer to FIGS. 7 and 8). Instead of having a rectangular cross section, the suspension frame 80 may have a cross section of another shape that allows an operator in the work cage 10 to perform operations above the suspension frame 80.

The suspension frame 80 allows an operator to perform operations in an upper area from inside the frame 81, 82, or 83, unlike in a structure including a single beam.

As shown in FIGS. 5 to 8, the lift mechanisms 90, which raise or lower the work cage 10, are attached to the frame 81, 82, or 83 of the suspension frame 80. The lift mechanisms 90 include multiple lanyards 91. For example, the multiple lanyards 91 include two wire ropes, and are suspended with their upper ends fixed.

As shown in FIGS. 2, 5, 7, and 8, a twist remover 91*a* for each lanyard 91 is arranged between the suspension frame 80 and the lanyard 91. The twist remover 91*a* allows the lanyard 91 to rotate about the center axis to prevent the lanyard 91 from being twisted.

The two suspended lanyards 91 are wound around the sheaves of endless winders 92 installed on the work cage 10. For example, two endless winders 92, which serve as the lift mechanisms 90, are installed on the left and right parts of the work cage 10. The work cage 10 has the two lanyards (wire ropes) 91 fixed to and suspended from the suspension frame 80 and wound around the sheaves of the endless winders 92. The work cage 10 is then raised and lowered while changing the winding positions under a frictional force between the lanyards 91 and the sheaves of the endless winders 92.

The endless winders 92 return to the original positions with manual rotations of the sheaves if the endless winders 92 malfunction.

The work cage 10 includes a rectangular work floor 11, on which operators stand. The work floor 11 is placed substantially perpendicular to the target wall surface during operation. The work floor 11 is surrounded by panels 12 to allow the operators to perform safe operations. As appropriate, handrails, sheets, or nets for protection against falling objects or debris resulting from the operation are attached to the work cage 10.

Figure 2:
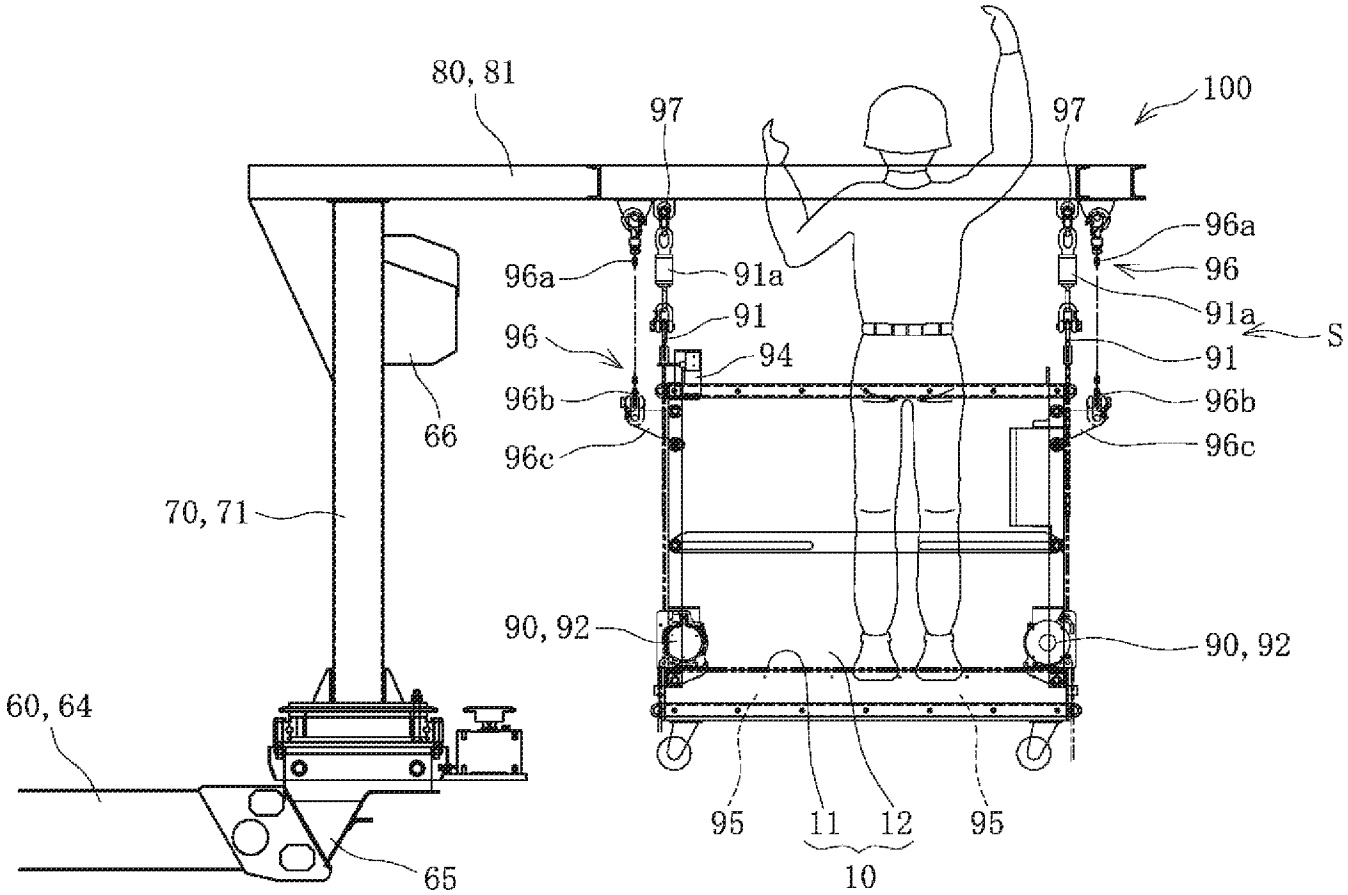
FIG. 2 is a partially enlarged schematic diagram of the work vehicle according to one embodiment of the present disclosure shown in FIG. 1.
Figure 3:
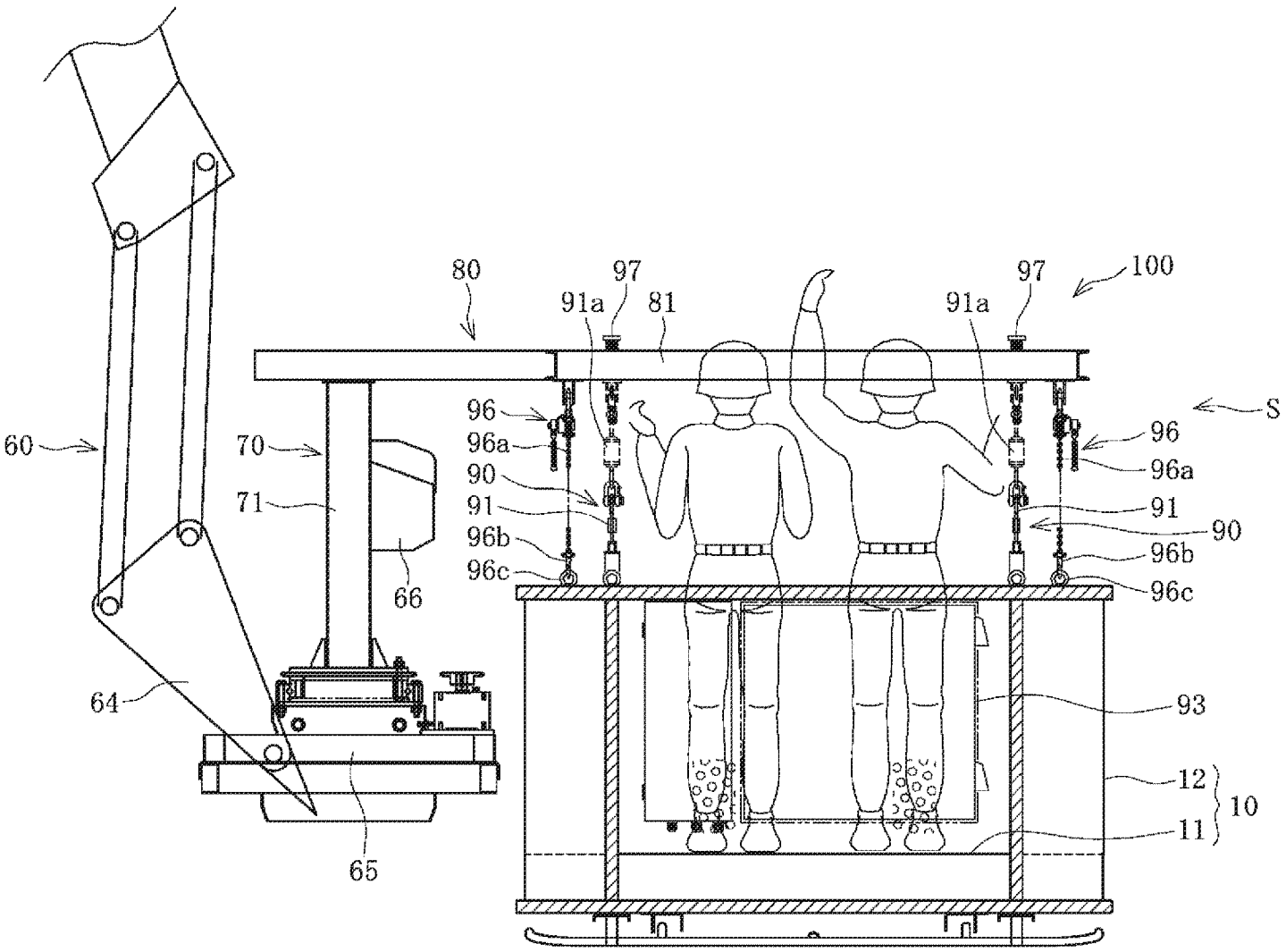
FIG. 3 is a schematic front view of the suspended platform according to one embodiment of the present disclosure.
Figure 5:
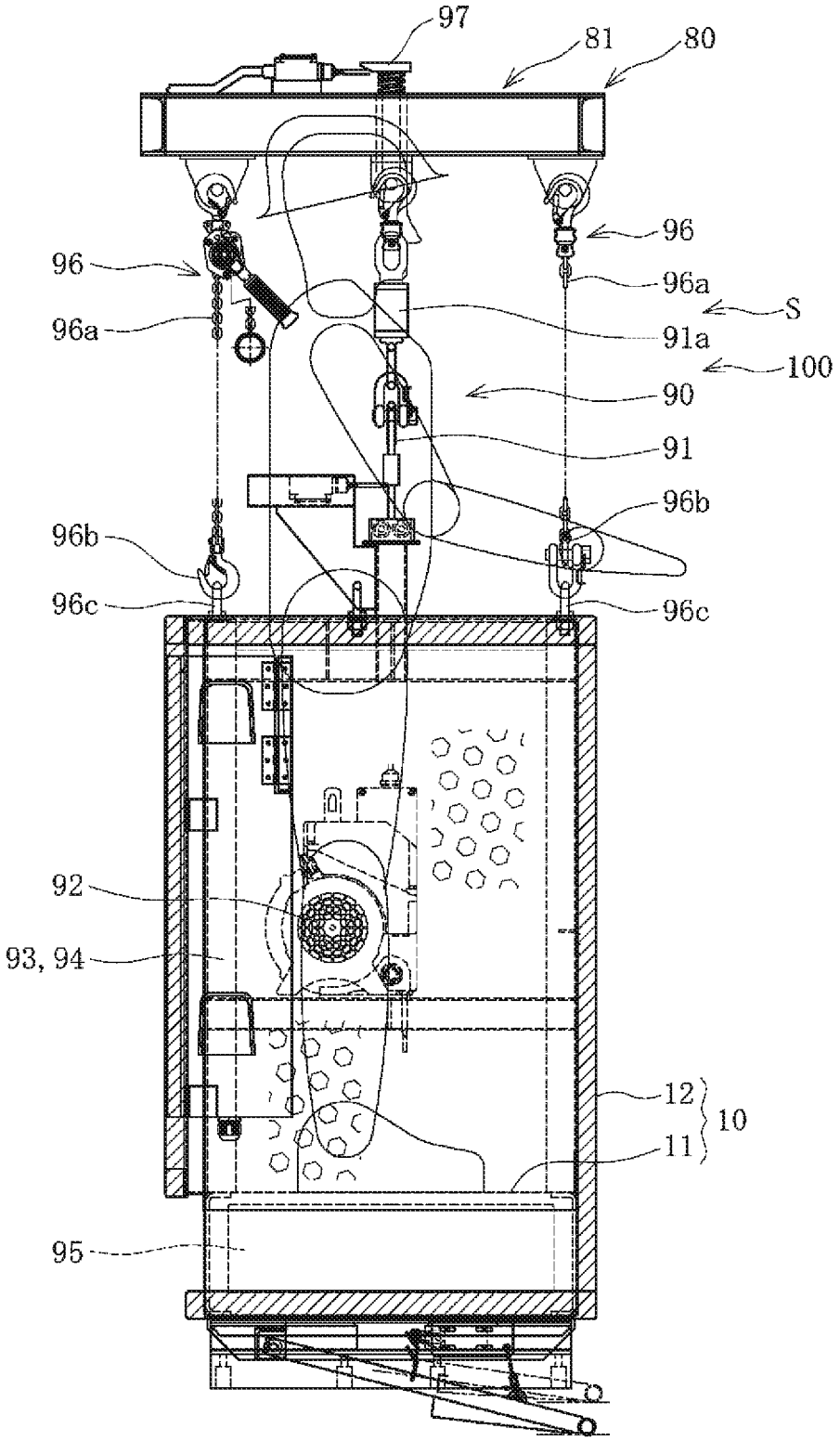
FIG. 5 is a schematic side view of the suspended platform according to one embodiment of the present disclosure.

As shown in FIGS. 2, 5, and 8, winding reels 95 for winding the two lanyards 91 are attached in a self-rotatable manner below the work floor 11 of the work cage 10. The winding reels 95 with a cage shape rotate in response to a push or pull of the lanyards 91 to coil up the lanyards 91 for storage.

The endless winders 92 are driven by a battery (not shown) mounted on the work cage 10. A battery panel 93, which contains a battery, and the work cage operation panel 94 are installed on the work cage 10. The battery mounted on the work cage 10 is rechargeable with power from an external power supply through a charging connector on the arm operation panel 66 when the work cage 10 is at the uppermost stop position S.

Regenerated current can be recovered to the battery from the driving motors of the endless winders 92 for energy saving.

The length of the lanyards 91 suspended from the suspension frame 80 can be adjusted by the endless winders 92 to correspond to the range in which the work cage 10 is raised or lowered. Thus, the operator can perform operations on the wall surface without limitations while raising or lowering the work cage 10 within an intended range.

To perform operations from the work cage 10, the rotational position of the suspension frame 80 about a vertical axis is adjusted by the rotation of the rotating post 71. The work cage 10 can thus be placed parallel to the target wall surface.

Figure 9:
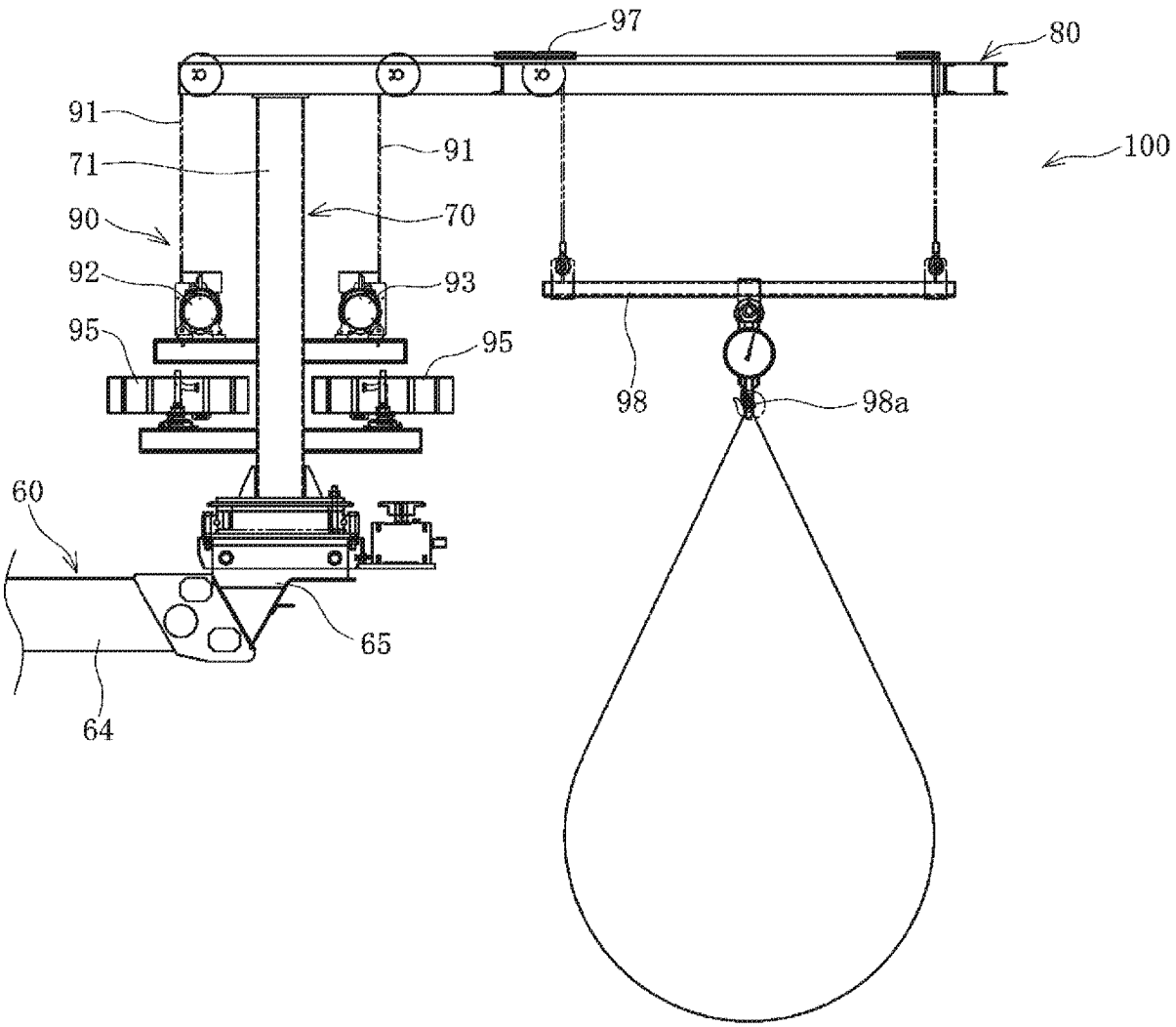
FIG. 9 is a schematic diagram of a suspended platform according to one embodiment of the present disclosure in a crane operation.

As shown in FIG. 9, for example, the suspended platform 100 may have the endless winders 92 fixed to the work cage mount 65 at the distal end of the arm mechanism 60 as winches, instead of being installed on the work cage 10.

The lanyards 91 may be wired from the fixed endless winders 92 to the suspension frame 80, and the suspended lanyards 91 such as wire ropes may be connected to the work cage 10 to be wound up or unwound to raise or lower the work cage 10. This structure may include a wireless operation panel for operating the winches, such as the endless winders 92, from the work cage 10, and a safe return unit additionally arranged to allow the operator to return to an operation start point when, for example, the winches such as the endless winders 92 malfunction.

The endless winders 92 installed on the work cage mount 65 allow a suspension beam 98 including a hook 98*a* to be arranged, in place of the work cage 10, at an intermediate point between the lanyards 91 suspended from the suspension frame 80, and enable a crane operation through the wireless operation panel.

In some embodiments, the endless winders 92 installed on the work cage 10 may be driven by an external power (power supply from a generator or other devices), in place of a battery, through power cables. This structure includes power cables and reels.

The work vehicle 1 including the suspended platform 100 includes an interlock mechanism for safe operation. The interlock mechanism operates mechanically and electrically.

During the operation of the suspended platform 100, the interlock mechanism disables the operation of the arm mechanism 60. More specifically, the arm operation panel 66 for the arm mechanism 60 is installed on the support post 70 at the distal end of the arm mechanism 60, or on the rotating post 71 in the present embodiment. Thus, the arm operation panel 66 is accessible to the operator only when the work cage 10 suspended from the suspension frame 80 is at the uppermost stop position S. Thus, after the work cage 10 is started to move (be lowered), the arm operation panel 66 becomes physically inaccessible to the operator to disable the operation of the arm mechanism 60.

For a mechanical lock mechanism, the work vehicle 1 includes fastening mechanisms 96 between the work cage 10 and the suspension frame 80 to fix the work cage 10 at the uppermost stop position S to the suspension frame 80 to prevent the work cage 10 from moving (from being lowered). When the upper ends of the fastening mechanisms 96 are fixed to the suspension frame 80 and hooks **96*b* at the lower ends of the fastening mechanisms 96 are hooked through the openings in the brackets 96*c* on the work cage 10, the work cage 10 is fastened to the suspension frame 80. The fastening mechanisms 96 enable simple fastening of the work cage 10 by, for example, slightly raising the work cage 10 from the uppermost stop position S, hooking the hooks 96*b* through the brackets 96*c* on the work cage 10, and then lowering the work cage 10 to the uppermost stop position S. The work cage 10 is released from the fastened state by being slightly raised and disconnected from the fastening mechanisms 96**.

The fastening mechanisms 96 fasten the work cage 10 to the suspension frame 80 to prevent the work cage 10 from moving (from being lowered). Thus, the two lanyards 91 are left unloaded.

A load detector 97 is attached to each lanyard 91 for suspending the work cage 10. The load detector 97 electrically detects the work cage 10 at the uppermost stop position S at which the lanyard 91 is unloaded. In other words, for the fastening mechanisms 96 to detect the work cage 10 fastened to the suspension frame 80, a load cell is installed in the suspension frame 80 to serve as a load detector 97. When the lanyard 91 is suspended from the suspension frame 80, the load detector 97 electrically detects the load on the load cell smaller than a predetermined value.

A mechanical system including a striker attached to the work cage 10 and a limit switch installed on the suspension frame 80 may be used as the load detector 97. The limit switch may obtain an electric signal indicating that the work cage 10 is at the uppermost stop position S. In some embodiments, a proximity sensor may be used to detect the position of the work cage 10 to obtain an electric signal indicating that the work cage 10 is at the uppermost stop position S.

The load detector 97 can electrically detect the work cage 10 at the uppermost stop position S at which the lanyard 91 is unloaded. This interlocks the work cage 10 for operations such as being raised and lowered.

Unless the work cage 10 is at the uppermost stop position S, the arm mechanism 60 is interlocked to allow no operation.

The work vehicle 1 including the suspended platform with the above structure is used to perform operations in the following manner.

The work vehicle 1 travels on the road to a work site.

At the work site, an operator prepares to start operations in the vehicle body 20, such as a typical bridge inspection vehicle or a boom lift vehicle. More specifically, the operator performs pre-operation checks, checks the parking conditions, including whether the vehicle is parked on a flat road surface or the state of the parking brake, and manipulates an outrigger.

The operator then enters the work cage 10 suspended at the uppermost stop position S at the distal end of the arm mechanism 60 and fastened with the fastening mechanisms 96.

Thereafter, the operator in the work cage 10 operates the arm operation panel 66 attached to the rotating post 71 to move the work cage 10 to an intended work position (operation start point) with the mechanisms 30, 40, and 50 of the arm mechanism 60.

The arm operation panel 66 is operable while the work cage 10 is interlocked, in which the work cage 10 is at the uppermost stop position S and mechanically fastened with the fastening mechanisms 96. This is detected by the load detector 97 that electrically detects the unloaded lanyard 91 or electrically detects the work cage 10 at the uppermost stop position S. This structure ensures the safety of an operation.

In addition, the rotating post 71 is rotated by the operation on the work cage operation panel 94 to place the work cage 10 parallel to the wall surface. This completes the preparations.

To start the operation with the work cage 10, the fastening mechanisms 96 release mechanical fastening of the work cage 10. The work cage 10 is slightly raised to unhook the hooks **96*b* of the fastening mechanisms 96 from the brackets 96*c* on the work cage 10**.

In response to releasing of the fastened state, the load detector 97 detects the loaded lanyard 91, or detects the work cage 10 moved from the uppermost stop position S (e.g., the work cage 10 is slightly lowered). Thus, the arm operation panel 66 is interlocked, disabling operations on the arm mechanism 60. The position of the suspension frame 80, from which the work cage 10 is suspended, is thus prevented from being unintentionally changed by the arm mechanism 60.

The operator in the work cage 10 can perform operations also above the suspension frame 80. Adjusting the uppermost stop position S of the arm mechanism 60 in advance thus enables operations above the suspension frame 80.

The operator operates the work cage operation panel 94 to raise or lower the work cage 10 to perform operations below the uppermost stop position S. For a curved work surface, the operator operates the work cage operation panel 94 to rotate the rotating post 71 to change the orientation of the work cage 10 to place the work cage 10 parallel to the wall surface for performing the operation.

After performing an operation by raising or lowering the distal end of the arm mechanism 60 to intended positions, the operator raises the work cage 10 to return to the uppermost stop position S to complete the operation in a single up-down range.

After the work cage 10 is fastened at the uppermost stop position S, the operator in the work cage 10 operates the arm operation panel 66 to repeatedly move the distal end of the arm mechanism 60 to the subsequent work position while performing operations by raising or lowering the work cage 10 in the same manner.

When returned to the uppermost stop position S, the battery mounted on the work cage 10 is recharged as appropriate.

After the operation on the entire wall surface is complete by repeatedly moving to another operation start point with the arm mechanism 60 and raising and lowering of the work cage 10 in combination, the arm mechanism 60 is operated to return to the initial position, allowing the work vehicle 1 to travel.

This completes the operation.

To use the work vehicle 1 as a crane truck, as shown in FIG. 9, the endless winders 92 are installed at the distal end of the arm mechanism 60, the suspension beam 98 is suspended with two lanyards 91, and a cargo is suspended using the hook 98*a* on the suspension beam 98. Then, the endless winders 92 are operated through the wireless operation panel. Thus, the work vehicle 1 can readily be used as a crane truck.

The above embodiment only describes the operation of raising or lowering the work cage suspended from the suspension frame. In some embodiments, the work cage may include a traversing mechanism movable lateral direction to further widen the operating range.

The present disclosure is not limited to the above embodiment, and each component may be modified without departing from the gist of the invention.

As described in detail in the embodiment, the work vehicle including a suspended platform according to an aspect of the present disclosure is the work vehicle 1 including the work cage 10 to carry an operator, and the arm mechanism 60, which moves its distal end to an intended position by at least one of the rotating mechanism 30, the extension mechanism 40, or the derricking mechanism 50 installed on the vehicle body 20. The work vehicle 1 includes the suspended platform 100, which includes the support post 70, the suspension frame 80, and the lift mechanisms 90. The support post 70 is located at the distal end of the arm mechanism 60 and extends vertically. The suspension frame 80, from which the work cage 10 is suspended, is mounted on the upper end of the support post 70 and located outside the work cage 10 to allow an operator to perform an operation above the upper end of the support post 70. The lift mechanisms 90 raise or lower the work cage 10, suspended from the suspension frame 80 with the lanyards 91, to a work position. The operation panel 66 for the arm mechanism 60 is operable from the work cage 10 at the upper stop position S and inoperable from the work cage 10 at a raised or lowered position. Thus, the work vehicle 1 can transport the suspended platform 100 by traveling a public road. The work cage 10 is thus movable to an intended position from above a road by the arm mechanism 60, and the raising or lowering of the work cage 10 allows a wide operating range. As in a boom lift vehicle, the work cage 10 suspended from the suspension frame 80 also enables an operation above the work cage 10, unlike known suspended platform.

The work cage 10 of the suspended platform 100 is thus movable to an intended position in an operating range without limitations, thus allowing an operation in a wide operating range.

This structure facilitates transportation to a work site or operational preparation or withdrawal at the work site, thus greatly improving the work efficiency as compared with when a work cage is suspended from, for example, a rooftop.

The operation panel 66 for the arm mechanism 60 is operable from the work cage 10 at the uppermost stop position S and inoperable from the work cage 10 at a raised or lowered position. Thus, the arm mechanism 60 becomes inoperable when the work cage 10 is raised or lowered to allow the operator in the work cage 10 to perform an intended operation safely.

A work vehicle including a suspended platform according to an aspect of the present disclosure is the work vehicle 1 including the work cage 10 to carry an operator, and the arm mechanism 60, which moves its distal end to an intended position by at least one of the rotating mechanism 30, the extension mechanism 40, or the derricking mechanism 50 installed on the vehicle body 20. The work vehicle 1 includes the suspended platform 100, which includes the support post 70, the suspension frame 80, and the lift mechanisms 90. The support post 70 is located at the distal end of the arm mechanism 60 and extends vertically. The suspension frame 80, from which the work cage 10 is suspended, is mounted on the upper end of the support post 70 and located outside the work cage 10 to allow an operator to perform an operation above the upper end of the support post 70. The lift mechanisms 90 raise or lower the work cage 10, suspended from the suspension frame 80 with the lanyards 91, to a work position. The work vehicle 1 includes the fastening mechanisms 96 between the work cage 10 and the suspension frame 80 to fasten the work cage 10 at the uppermost stop position S. The work vehicle 1 includes the load detector 97 installed in the suspension frame 80 to detect a fastened state of the work cage 10 at the uppermost stop position S based on the load on the lanyard 91. Thus, the suspended platform 100 is transportable through a public road. The work cage 10 is thus movable to an intended position from above a road by the arm mechanism 60, and is raised or lowered to allow an operation in a wide operating range. As in a boom lift vehicle, the work cage 10 suspended from the suspension frame 80 also enables an operation above the work cage 10, unlike known suspended platform.

The work cage 10 of the suspended platform 100 is movable to an intended position in an operating range without limitations, thus allowing an operation in a wide operating range.

This structure facilitates transportation to a work site or operational preparation or withdrawal at the work site, thus greatly improving the work efficiency as compared with when a work cage is suspended from, for example, a rooftop.

The work vehicle 1 includes the fastening mechanisms 96 between the work cage 10 and the suspension frame 80 to fasten the work cage 10 at the uppermost stop position S. The work vehicle 1 includes the load detector 97 installed in the suspension frame 80 to detect a fastened state of the work cage 10 at the uppermost stop position S based on the load on the lanyard 91. The fastening mechanisms 96 can firmly fasten the work cage 10 at the uppermost stop position S, and the load detector 97 can detect an electric signal indicating the position of the work cage 10. Thus, the suspended platform 100 is interlocked depending on the position of the work cage 10, thus allowing safe operations.

A work vehicle including a suspended platform according to an aspect of the present disclosure is the work vehicle 1 including the work cage 10 to carry an operator, and the arm mechanism 60, which moves its distal end to an intended position at least one of the rotating mechanism 30, the extension mechanism 40, or the derricking mechanism 50 installed on the vehicle body 20. The work vehicle 1 includes the suspended platform 100, which includes the support post 70, the suspension frame 80, and the lift mechanism 90. The support post 70 is located at the distal end of the arm mechanism 60 and extends vertically. The suspension frame 80, from which the work cage 10 is suspended, is mounted on the upper end of the support post 70 and located outside the work cage 10 to allow an operator to perform an operation above the upper end of the support post 70. The lift mechanism 90 raises or lowers the work cage 10, suspended from the suspension frame 80 with the lanyards 91, to a work position. The lift mechanism 90 in the suspended platform 100 is driven by a battery mounted on the work cage 10. The work cage 10 is rechargeable at the uppermost stop position S with power from an external power supply. Thus, the suspended platform 100 is transportable through a public road. The work cage 10 is thus movable to an intended position from above a road by the arm mechanism 60, and the raising or lowering of the work cage 10 allows an operation in a wide operating range. As in a boom lift vehicle, the work cage 10 suspended from the suspension frame 80 also enables an operation above the work cage 10, unlike known suspended platform.

The work cage 10 of the suspended platform 100 is movable to an intended position in an operating range without limitations, thus allowing an operation in a wide operating range.

This structure facilitates transportation to a work site or operational preparation or withdrawal at the work site, thus greatly improving the work efficiency as compared with when a work cage is suspended from, for example, a rooftop.

The lift mechanism 90 in the suspended platform 100 is driven by a battery mounted on the work cage 10. The work cage 10 is rechargeable at the uppermost stop position S with power from an external power supply. The lift mechanism 90 thus has no power cable between the arm mechanism 60 and the work cage 10. This structure thus eliminates operational obstructions or limitations in the operating range, and enables easy recharging of the work cage 10 at the uppermost stop position S.

In the work vehicle 1 including a suspended platform according to an aspect of the present disclosure, the support post 70 includes the rotating post 71, which rotates about a vertical axis. Thus, the direction of the suspension frame 80 is changeable about the vertical axis by rotating the rotating post 71 to adjust the orientation of the work cage 10 for performing operations on, for example, wall surfaces.

In the work vehicle 1 including a suspended platform according to an aspect of the present disclosure, the operation panel 66 for the arm mechanism 60 is operable from the work cage 10 at the uppermost stop position S and inoperable from the work cage 10 at a raised or lowered position. Thus, an operator in the raised or lowered work cage 10 is unable to operate the arm mechanism 60, thus allowing the operator in the work cage 10 to perform an intended operation safely.

The work vehicle 1 including a suspended platform according to an aspect of the present disclosure includes the fastening mechanisms 96 between the work cage 10 and the suspension frame 80 to fasten the work cage 10 at the uppermost stop position S. The work vehicle 1 includes the load detector 97 installed in the suspension frame 80 to detect a fastened state of the work cage 10 at the uppermost stop position S based on the load on the lanyard 91. The fastening mechanisms 96 can firmly fasten the work cage 10 at the uppermost stop position S, and the load detector 97 detects an electric signal indicating the position of the work cage 10. Thus, the suspended platform is interlocked depending on the position of the work cage 10, thus allowing an operator to perform safe operations.

In the work vehicle including a suspended platform according to an aspect of the present disclosure, the lift mechanisms 90 in the suspended platform 100 are driven by the battery panel 93 mounted on the work cage 10. The work cage 10 is rechargeable at the uppermost stop position S with power from an external power supply. The lift mechanisms 90 thus have no power cable between the arm mechanism 60 and the work cage 10. This structure eliminates operation obstructions or limitations in the operating range, and allows easy recharging at the uppermost stop position S.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2016-203811, filed on Oct. 17, 2016, the entire disclosure of which is incorporated by reference herein.

REFERENCE SIGNS LIST

1 Work vehicle (Work vehicle including suspended platform)
10 Work cage
11 Work floor
12 Panel
20 Vehicle body
30 Rotating mechanism
31 Rotating platform
32 Rotating platform
40 Extension mechanism
50 Derricking mechanism
51 Derricking shaft
52 Leveling arm
53 Derricking shaft
54 Derricking shaft
60 Arm mechanism
61 First boom
62 Second boom
63 Third boom
64 Fourth boom
65 Work cage mount
66 Arm operation panel
70 Support post
71 Rotating post
80 Suspension frame
81 Frame
82 Frame
83 Frame
90 Lift mechanism
91 Lanyard
91*a* Twist remover
92 Endless winder
93 Battery panel
94 Work cage operation panel
95 Winding reel
96 Fastening mechanism
96*a* Fastening rod
96*b* Hook
96*c* Bracket
97 Load detector
98 Suspension beam
98*a* Hook

100 Suspended platform
S Uppermost stop position

The invention claimed is:

1. A work vehicle including a suspended platform, the work vehicle comprising:

a work cage configured to carry an operator;

an arm mechanism having a distal end, the distal end being movable to an intended position by at least one of a rotating mechanism, an extension mechanism, or a derricking mechanism that are installed on a vehicle body; and the suspended platform comprising a support post located at the distal end of the arm mechanism and extending vertically, a suspension frame from which the work cage is suspended, the suspension frame being mounted on an upper end of the support post, being and located outside the work cage allowing the operator to perform an operation on a portion above the upper end of the support post, and a lift mechanism configured to raise or lower the work cage to a work position, the work cage being suspended from the suspension frame with a plurality of lanyards, wherein the arm mechanism comprises an operation panel that is operable from the work cage at an uppermost stop position and inoperable from the work cage at a raised or lowered position.

2. The work vehicle according to claim 1, further comprising:

a fastening mechanism located between the work cage and the suspension frame to fasten the work cage at an uppermost stop position; and a load detector installed in the suspension frame to detect a fastened state of the work cage at the uppermost stop position based on a load on at least one of the lanyards.

3. The work vehicle according to claim 1, wherein:

the lift mechanism in the suspended platform is driven by a battery mounted on the work cage, and the work cage has the battery rechargeable at an uppermost stop position with power from an external power supply.

4. The work vehicle according to claim 2, wherein:

the lift mechanism in the suspended platform is driven by a battery mounted on the work cage, and the work cage has the battery rechargeable at an uppermost stop position with power from an external power supply.

5. The work vehicle according to claim 1, wherein the support post comprises a rotating post configured to rotate about a vertical axis.

6. The work vehicle according to claim 2, wherein the support post comprises a rotating post configured to rotate about a vertical axis.

7. The work vehicle according to claim 3, wherein the support post comprises a rotating post configured to rotate about a vertical axis.

8. The work vehicle according to claim 4, wherein the support post comprises a rotating post configured to rotate about a vertical axis.

* * * * *